US007041010B2

(12) United States Patent
Ninomiya et al.

(10) Patent No.: US 7,041,010 B2
(45) Date of Patent: May 9, 2006

(54) GOLF BALL AND METHOD OF MANUFACTURING THE SAME

(75) Inventors: Norikazu Ninomiya, Osaka (JP); Kenji Onoda, Kashihara (JP); Masao Ogawa, Osaka (JP); Yuri Naka, Katano (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/885,043

(22) Filed: Jul. 7, 2004

(65) Prior Publication Data

US 2005/0037867 A1 Feb. 17, 2005

(30) Foreign Application Priority Data

Jul. 8, 2003 (JP) ..... 2003-271968

(51) Int. Cl.
*A63B 37/06* (2006.01)

(52) U.S. Cl. ..... 473/377

(58) Field of Classification Search ..... 473/373, 473/374, 376, 368, 367, 377

See application file for complete search history.

(56) References Cited

U.S. PATENT DOCUMENTS

| | | | | |
|---|---|---|---|---|
| 698,516 | A | 4/1902 | Kempshall | |
| 4,173,345 | A | 11/1979 | Pocklington | |
| 4,229,401 | A | 10/1980 | Pocklington | |
| 5,836,834 | A * | 11/1998 | Masutani et al. | 473/374 |
| 5,984,807 | A | 11/1999 | Wai et al. | |
| 6,004,226 | A * | 12/1999 | Asakura | 473/373 |
| 2004/0171436 | A1 * | 9/2004 | Sullivan | 473/371 |

FOREIGN PATENT DOCUMENTS

| | | |
|---|---|---|
| JP | 49-136364 | 3/1973 |
| JP | 92-270178 | 11/1987 |
| JP | 2003-24472 | 1/2003 |

* cited by examiner

*Primary Examiner*—Raeann Gorden
(74) *Attorney, Agent, or Firm*—Armstrong, Kratz, Quintos, Hanson & Brooks, LLP

(57) ABSTRACT

A golf ball comprising a spherical core (1) and a cover (3) covering the spherical core (1), wherein the core (1) is provided with grooves (5) along three great circles drawn on the surface of the core (1) so as to intersect each other at right angles, and projections (9) engaging in the grooves (5) are provided on the inner surface of the cover (3). A golf ball with such a structure has both high resilience and soft feel when hit.

12 Claims, 10 Drawing Sheets

(a)

(b)

(a)

(b)

(a)

(b)

(a)

(b)

(a)

(b)

GOLF BALL AND METHOD OF MANUFACTURING THE SAME

TECHNICAL FIELD

The present invention relates to a golf ball comprising a spherical core and a cover provided over the spherical core.

BACKGROUND ART

Recently, several proposals for golf balls exhibiting both high ball resilience and soft impact feel have been proposed. An example of a conventional two-piece golf ball is disclosed in Japanese Unexamined Patent Publication No. 1987-270178. In the golf ball of this publication, many depressions and projections are provided on the surface of the core, and the cover and the core are connected to each other through these depressions and projections. In this structure, because the contact between the core and the cover is improved, energy losses when energy is transferred from the cover to the core can be reduced, and ball resilience thereby improved.

In the golf ball disclosed in the above-mentioned publication, because the core and the cover are firmly connected through depressions and projections formed over the entire surface of the core, deformation of the cover in the spherical surface direction when hit is greatly reduced. Therefore, the degree of flexibility in deformation of the cover is reduced and this deteriorates impact feel.

DISCLOSURE OF THE INVENTION

An object of the present invention is to overcome the above drawbacks and provide a golf ball having a high resilience and soft impact feel.

The present invention provides a golf ball comprising a spherical core and a cover covering the spherical core, wherein the core is provided with grooves on three great circles drawn around the core so as to intersect each other at right angles, and the inner surface of the cover is provided with projections engaging in the grooves.

In this structure, because the grooves formed on the surface of the core engage in the projections formed on the inner surface of the cover, contact between the cover and the core is enhanced and displacement between the cover and the core when the ball is hit is reduced. This reduces energy losses when energy is transferred from the cover to the core when hit, improving the ball resilience.

Furthermore, in such a golf ball, the grooves are not formed over the entire surface of the core but only along three great circles drawn on the surface of the core so as to intersect each other at right angles. Therefore, since neither grooves nor projections are formed in the regions bounded by the great circles, some extent of deformation is allowed in these regions, preventing impact feel from becoming hard. As described above, the present invention achieves high ball resilience and soft impact feel in the same golf ball.

The grooves may be formed so as to continuously extend along the great circles or be dividedly disposed in a plurality of locations along the great circles. In this latter case, it is preferable that the plurality of grooves be arranged substantially point symmetrical around the center of the core. Such a structure makes it possible to obtain substantially equal ball resilience and soft feel regardless of which point of the surface the ball is hit.

It is also possible to form the golf ball so that the core comprises a spherical main part and an interlayer covering the surface of the main part with the grooves being formed on the surface of the interlayer. In this case too, because energy losses when energy is transferred are reduced, it is possible to enhance the ball resilience.

If such an interlayer is provided, because the hardness of the main part can be differentiated from that of the interlayer, it is possible to easily obtain desirable properties that can cope with various conditions such as head speed. For example, by setting the hardness of the interlayer higher than that of the main part and setting the hardness of the cover lower than that of the interlayer, it is possible to increase the carry distance while maintaining excellent ball resilience due to the interlayer, and improve soft impact feel due to the cover.

In contrast, by setting the hardness of the interlayer lower than that of the main part and setting the hardness of the cover higher than that of the interlayer, it is possible to increase the carry distance while maintaining excellent ball resilience due to the main part and the cover, and improve soft impact feel due to the interlayer.

In prior art examples, because many depressions and projections are provided on the core surface, it is impossible to remove the core without using a mold that can be disassembled into many parts, adversely affecting productivity. Therefore, in the present invention, the grooves are so formed that the core can be easily removed without being caught in the mold even if a pair of molds that can be split in half are used. Specifically, the grooves are formed by excising a portion of bands that extend along each of three great circles that are hypothetically drawn on the surface of the core so as to intersect each other, and that have a sector shape in cross section with the arc section of the sector corresponding to the core surface, the excision being made along a plane that is perpendicular to a line normal to the core that passes through the midpoint between the intersections of the three great circles. By forming the core using such a pair of molds that can be split in half, it is possible to improve productivity, reduce production time, and prepare the molds at low cost. The plane excising the bands may pass the top portion of the sector-shaped cross-sectional profile of the band or a portion exterior in the radial direction to the top portion of the sector-shaped cross-sectional profile of the band.

In the golf ball of the present invention, it is preferable that the depth of each groove as measured from the surface of the core be 1 to 2 mm. This is because, if the depth of the groove is less than 1 mm, displacement between the core and the cover occurs and increases loss of energy when hit, decreasing the ball resilience. On the other hand, if its depth is more than 2 mm, the projections engage in the grooves too firmly, deteriorating impact feel.

When the core is formed by defining such bands, if the depth of each groove is within this range, to obtain both excellent ball resilience and soft feel, it is preferable that the width of the groove be 3.8 to 8.5 mm, or the vertical angle of the sector be 90 to 150°.

Golf balls of the present invention can be manufactured by various methods, for example, a golf ball comprising a core by drawing the above-explained bands may be manufactured by the following method. The method comprises a first step of preparing a core-mold provided with projections corresponding to the grooves on the inner surface thereof, the core-mold being able to be split in half by a parting line on a plane that intersects one of the three great circles at a right angle and the two other great circles at 45°, a second step of producing a core by placing a material for the core in the core-mold and conducting compression molding, and a third step of providing a cover around the surface of the core produced in the second step. This makes it possible to easily remove the core from the core-mold.

It is possible to arrange the method for manufacturing the golf ball so that the above-described second step comprises a step of placing a spherical main part in the core-mold and then placing a material having a hardness different from that of the main part in a space between the main part and the core-mold. Because it is possible to hold the main part in the center of the core-mold by the projections provided on the inner surface of the core-mold when the main part is placed therein, it is possible to reliably prevent the eccentricity of the core (i.e., displacement between the center of the core and the center of gravity of the core).

BEST MODE FOR CARRYING OUT THE INVENTION (First Embodiment)

Figure 1:
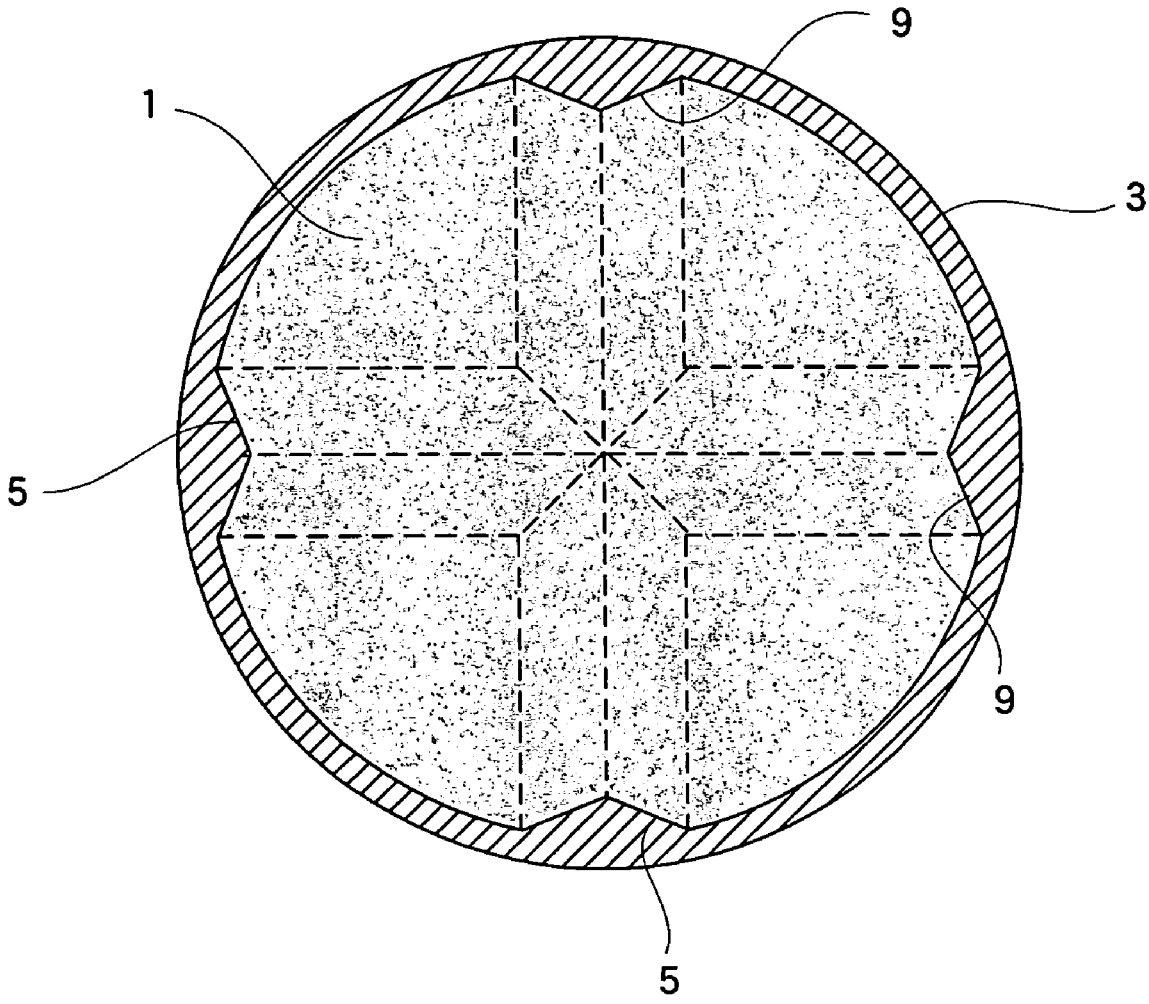
FIG. 1 is a cross-sectional view showing a golf ball according to a first embodiment of the present invention.

A first embodiment of a golf ball of the present invention is explained below. FIG. 1 is a cross-sectional view of a golf ball of the present invention.

As shown in FIG. 1, the golf ball of the present embodiment is a so-called two-piece golf ball comprising a core 1 and a cover 3 that covers the core 1. According to the rules (see R&A and USGA), the diameter of a golf ball should be no smaller than 42.67 mm. However, taking aerodynamic characteristics and the like into consideration, it is preferable that the diameter of the ball be as small as possible. Therefore, it can be, for example, 42.7 mm.

Figure 2:
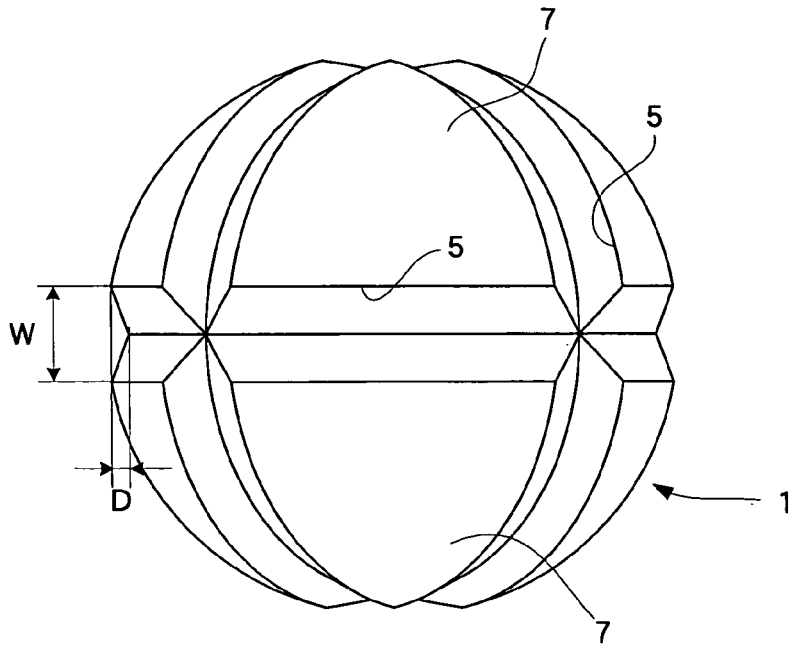
FIG. 2 shows (a) a front view and (b) a plan view of the core of the golf ball shown in FIG. 1.
Figure 2:
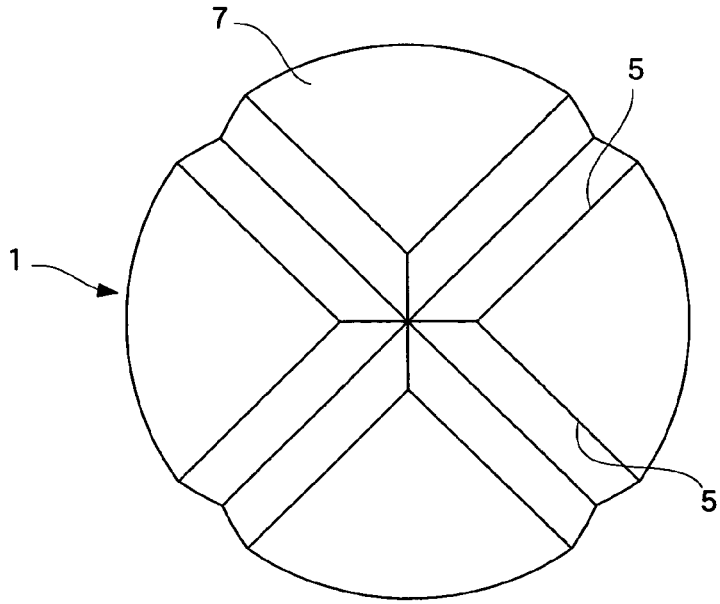

FIG. 2(*a*) is a front view of the core and FIG. 2(*b*) is a plan view of the core. The core 1 is spherically shaped as shown in the figures, and is composed of a rubber composition. It is preferable that the diameter of the core 1 be set in the range from 37.5 to 40.7 mm, and more preferably from 38.1 to 39.5 mm. This is because, when the diameter of the core is smaller than 37.5 mm, the thickness of the cover becomes large and the impact feel is deteriorated. On the other hand, when the diameter of the core is larger than 40.7 mm, the cover 3 must be made thin and this reduces the durability of the ball. It is preferable that the core 1 have a Shore D hardness of 40 to 55.

Grooves 5 each having a V-shaped cross-sectional profile are provided on the surface of the core 1. These grooves 5 are formed along three great circles drawn around the core 1 so as to intersect each other at right angles. Eight regions 7 surrounded by the grooves 5 are formed on the surface of the core 1. It is preferable that the depth D of each groove 5, i.e., the distance in a radial direction from the surface of the core 1 to the deepest portion of the groove 5, be 1.0 to 2.0 mm, and more preferably 1.5 to 1.8 mm. The reasons for this will be described later.

Core 1 may be formed from known rubber compositions containing base rubbers, cocross-linking agents, metal salts of unsaturated carboxylic acids, fillers, etc. Natural rubber, polyisoprene rubber, styrene-butadiene rubber, ethylene-propylene-diene rubber (EPDM) and the like may be used as a base rubber. However, it is preferable to use a high-cis polybutadiene rubber that contains 40% or more cis-1, 4-bonds and preferably 80% or more.

Specific examples of cross-linking agents include dicumyl peroxide, t-butylperoxide and like organic peroxides; however, it is particularly preferable to use dicumyl peroxide. The compounding ratio of the cross-linking agent is generally 0.3 to 5 parts by weight, and preferably 0.5 to 2 parts by weight, based on 100 parts by weight of base rubber.

As metal salts of unsaturated carboxylic acids, it is preferable to use monovalent or divalent metal salts of acrylic acid, methacrylic acid and like $C_3$ to $C_8$ unsaturated carboxylic acids. Among these, use of zinc acrylate can improve the ball resilience and is particularly preferable. The compounding ratio of unsaturated carboxylic acid metal salt is preferably 10 to 40 parts by weight, based on 100 parts by weight of the base rubber.

Examples of fillers include those generally added to cores. Specific examples thereof include zinc oxide, barium sulfate, calcium carbonate, etc. The preferable compounding ratio of filler is 2 to 50 parts by weight, based on 100 parts by weight of base rubber. If necessary, it is also possible to add antioxidants, peptizers and the like.

In addition to the above-mentioned rubber compositions, it is also possible to use known elastomers as a material for the core.

The cover 3 is formed from elastomer and, as shown in FIG. 1, covers the surface of the core 1. Predetermined dimples (not shown) are formed on the surface of the cover 3. In contrast, projections 9 that engage in the grooves 5 are formed on the inner surface of the cover 3 in contact with the core 1. These projections 9 have the same cross-sectional profile as the grooves 5 and extend along the three great circles so as to be placed in the entire length of each groove 7.

It is preferable that the cover 3 have a Shore D hardness of 55 to 65. The thickness of the cover 3 is preferably 1.0 to 2.6 mm and more preferably 1.6 to 2.3 mm. This is because, when the thickness of the cover 3 is smaller than 1.0 mm, the durability of the cover 3 is significantly decreased and it is difficult to mold; on the other hand, when its thickness exceeds 2.6 mm, the cover 3 is hard and impact feel when hit is deteriorated. The thickness of the cover 3 is defined as the distance from any point of its outermost portion in the radial direction where no dimples are formed to a point that contacts the core where no projections 9 are formed as measured along the normal line.

Examples of elastomers usable for forming the cover 3 include styrene-butadiene-styrene block copolymers (SBS), styrene-isoprene-styrene block copolymers (SIS), styrene-ethylene-butylene-styrene block copolymers (SEBS), styrene-ethylene-propylene-styrene block copolymers (SEPS) and like styrene-based thermoplastic elastomers; olefin-based thermoplastic elastomers having polyethylene or polypropylene as a hard segment and butadiene rubber or ethylene-propylene rubber as a soft segment; vinyl chloride-based plastic elastomers having crystallized poly(vinyl chloride) as a hard segment and amorphous poly(vinyl chloride) or an acrylonitrile butadiene rubber as a soft segment; urethane-based plastic elastomers having polyurethane as a hard segment and polyether or polyester urethane as a soft segment; polyester-based plastic elastomers having polyester as a hard segment and polyether or polyester as a soft segment; amide-based plastic elastomers having polyamide as a hard segment and polyether or polyester as a soft segment; ionomer resins; balata rubber, etc.

A method for manufacturing the golf ball having such a structure is explained below. First, a first mold (not shown) having an inner surface corresponding to the outer surface of the core 1 is prepared. The first mold can be disassembled into a plurality of parts so that the grooves 5 are not caught when the core 1 is removed. Second, the above-mentioned material for the core is placed in the mold, and compression molding is conducted at about 140 to 170° C. for 5 to 30 minutes. It is also possible to form the core not only by compression molding but also by injection molding. Subsequently, the thus formed core 1 is placed in a second mold and covered by a cover 3 by a known injection molding method. It is also possible to form the cover 3 by covering the core with a cover-material that has been formed into a pair of hemispherical shells beforehand and conducting compression molding.

In the thus formed golf ball, because the grooves 5 formed on the surface of the core 1 engage in the projections 9 formed on the inner surface of the cover 3, the contact between the cover 3 and the core 1 is strengthened, preventing displacement of the cover 3 from the core 1 when hit. This reduces energy losses when energy is transferred from the cover 3 to the core 1 when hit, improving resilience of the ball.

Furthermore, in the golf ball of the present embodiment, the grooves 5 are not provided over the entire surface of the core 1 but the grooves 5 and the projections 9 engage in only along three great circles around the core 1. If the grooves 5 and the projections 9 are formed over the entire surface of the sphere as in the prior art examples, the cover 3 contacts with the core 1 too strongly and is barely deformable, and this deteriorates the impact feel. In contrast, in the golf ball of the present embodiment, deformation of the cover is allowed to some extent in the regions 7 where no projections 9 are formed, preventing the impact feel from being hard. As a result, it is possible to provide both a high resilience and soft feel when hit in the same ball.

The depth D of the grooves 5 is set in the above-described range. This is because, if the depth D is more than 2 mm, the projections 9 engage in the grooves 5 too strongly and deformation hardly occurs, hardening impact feel. On the other hand, if the depth D is smaller than 1.0 mm, the cover 3 is easily displaced from the core 1, and this increases energy losses when hit and decreases ball resilience.

(Second Embodiment)

Figure 3:
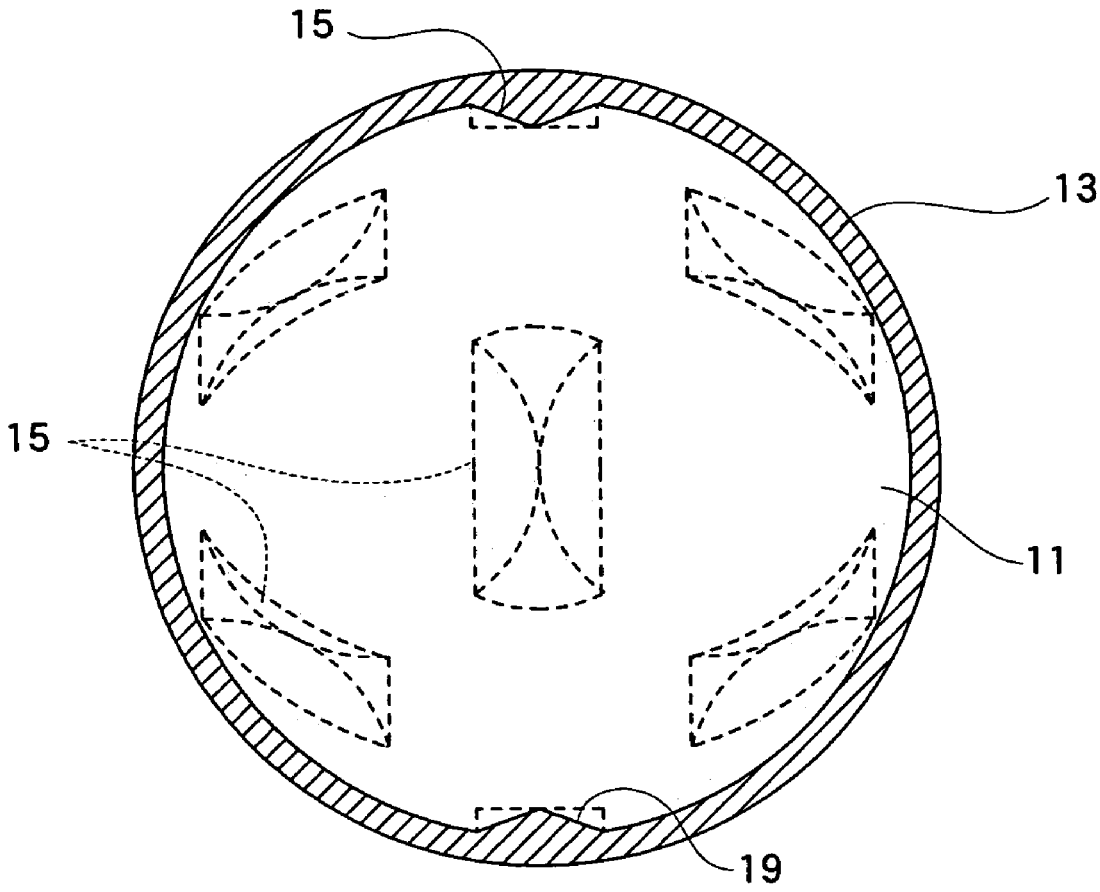
FIG. 3 is a cross-sectional view showing a golf ball according to a second embodiment of the present invention.
Figure 4:
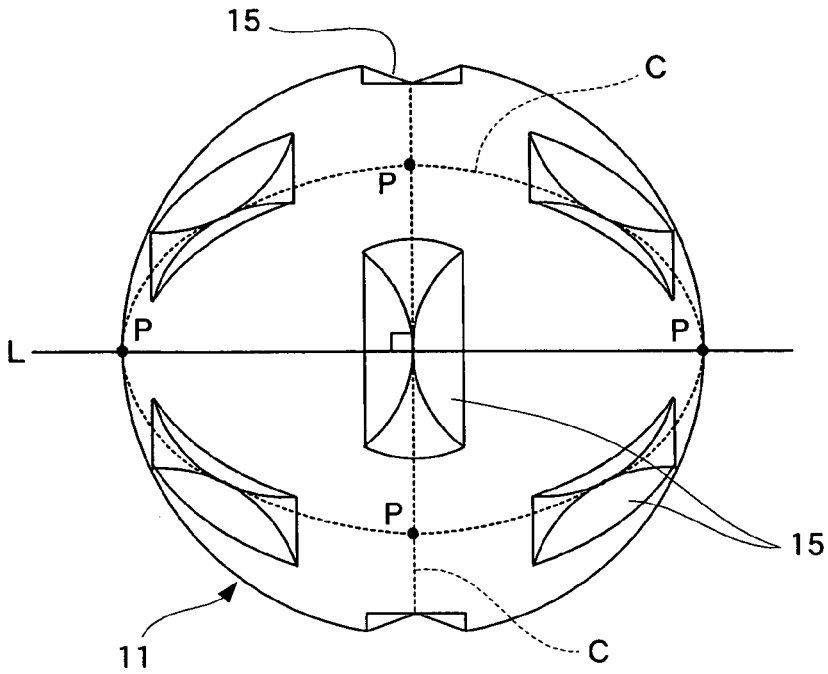
FIG. 4 shows (a) a front view and (b) a side view of the core of the golf ball shown in FIG. 3.
Figure 4:
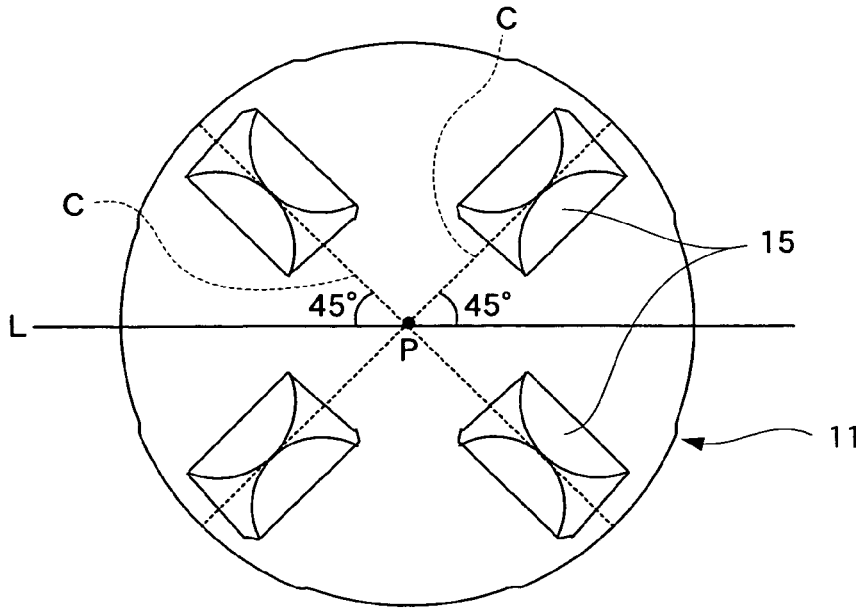

A second embodiment of the present invention is explained with reference to the drawings. FIG. 3 is a cross-sectional view of the golf ball of the present embodiment and FIG. 4 is (a) front view and (b) a side view of a core.

As shown in FIG. 3, the golf ball of the present embodiment is a two-piece golf ball comprising a core 11 and a cover 13 covering the core 11. As shown in FIG. 4, grooves 15 are formed on the surface of the core 11 of the golf ball as in the first embodiment. Each groove 15 extends along three great circles C drawn on the surface of the core 11 so as to intersect to each other at right angles; however the grooves 15 are not formed over the entire length of the great circles C but only some portions thereof. In other words, each grooves 15 is formed in a portion of each arc section between the intersections P of the great circles C, and the grooves 15 are not connected to each other.

To be more specific, each grooves 15 is formed as below. A method for forming the grooves 15 is explained with reference to FIGS. 5 to 8.

Figure 5:
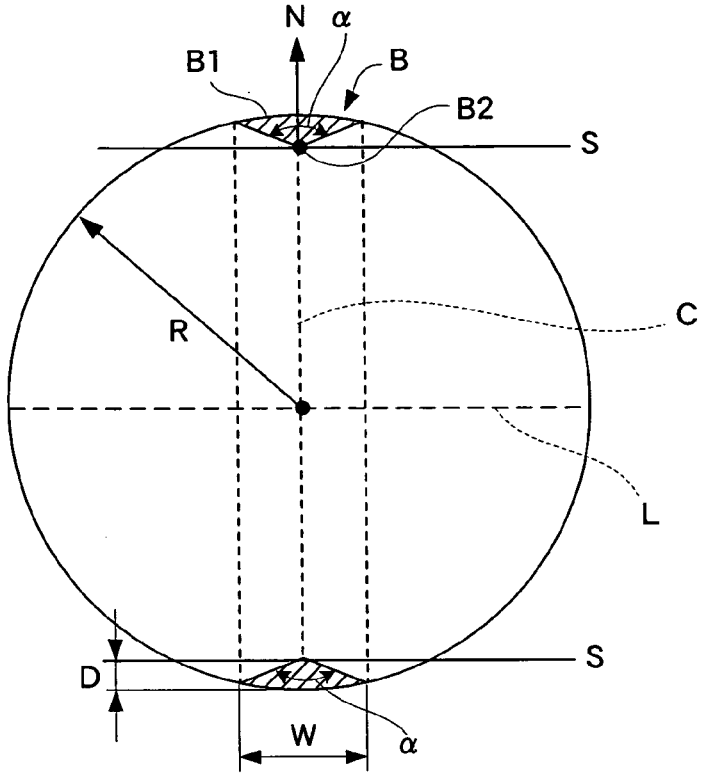
FIG. 5 is a cross-sectional view of the core, the figure explaining a method for forming the grooves on the core of FIG. 4.
Figure 6:
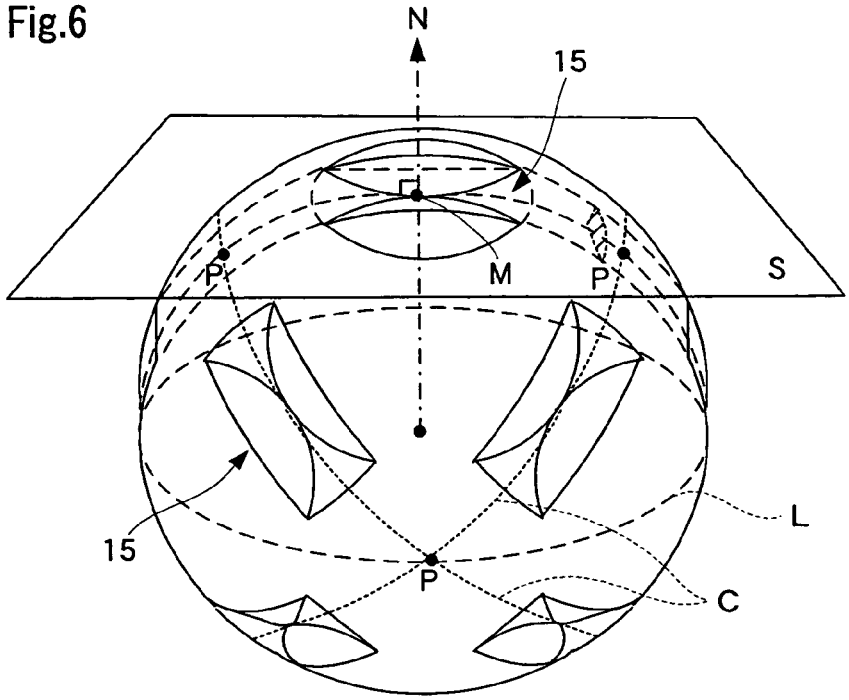
FIG. 6 is a perspective view of the core of FIG. 4, the figure explaining a method for forming the grooves on the core.
Figure 7:
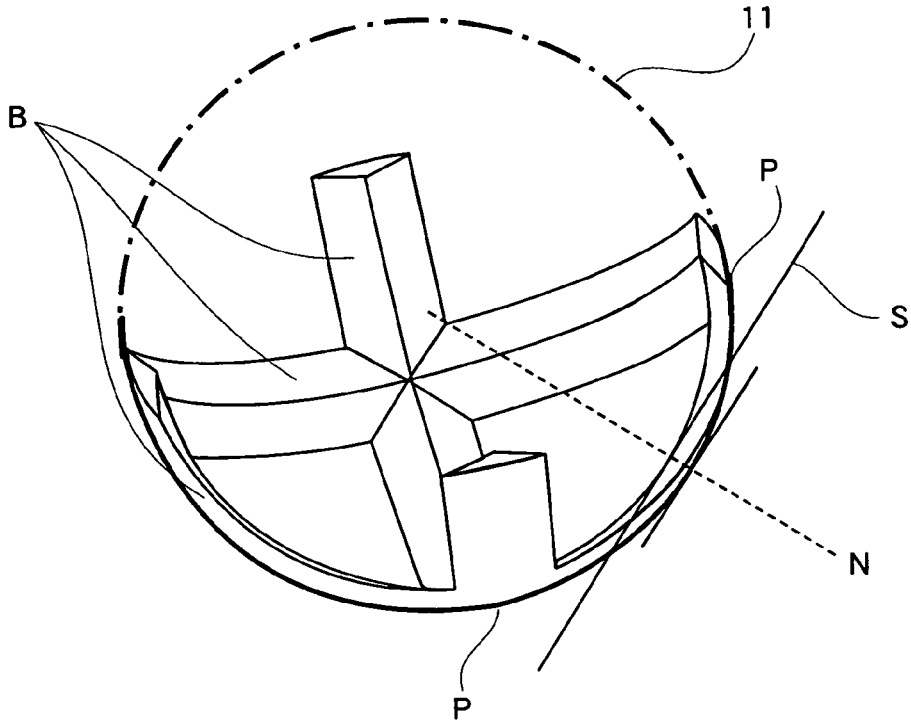
FIG. 7 is a partial perspective view showing three bands for explaining a method for forming the grooves on the core of FIG. 4.
Figure 7:
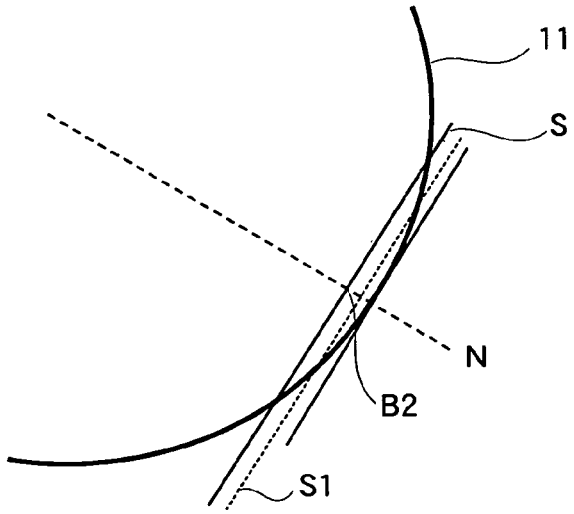

FIGS. 5 and 6 are respectively a cross-sectional view and a perspective view of the core, explaining a method for forming the grooves. First, bands B extending along the three great circles C are hypothetically drawn on the surface of the core 11. FIG. 5 shows a band B drawn along one of the great circles C. FIG. 7(*a*) is a perspective view showing a portion of the three bands thus drawn.

Each band B is so formed as to have a sector-shaped profile in cross section with the arc section B1 corresponding to the surface of the core 11. In other words, the radius of curvature of the arc section B1 is coincident with the radius R of the core 11.

Subsequently, a virtual plane S which is perpendicular to a normal line N of the core 11 passing through the midpoint M between two adjacent intersections P of the great circles and passes the top portion B2 of the sector is formed. An exterior portion of the band B in the radial direction is excised by the plane S. Here, the excised portion of the band B is defined as a groove 15. FIG. 7(*b*) is an enlarged view of the portion where the band is excised in FIG. 7(*a*).

Figure 8:
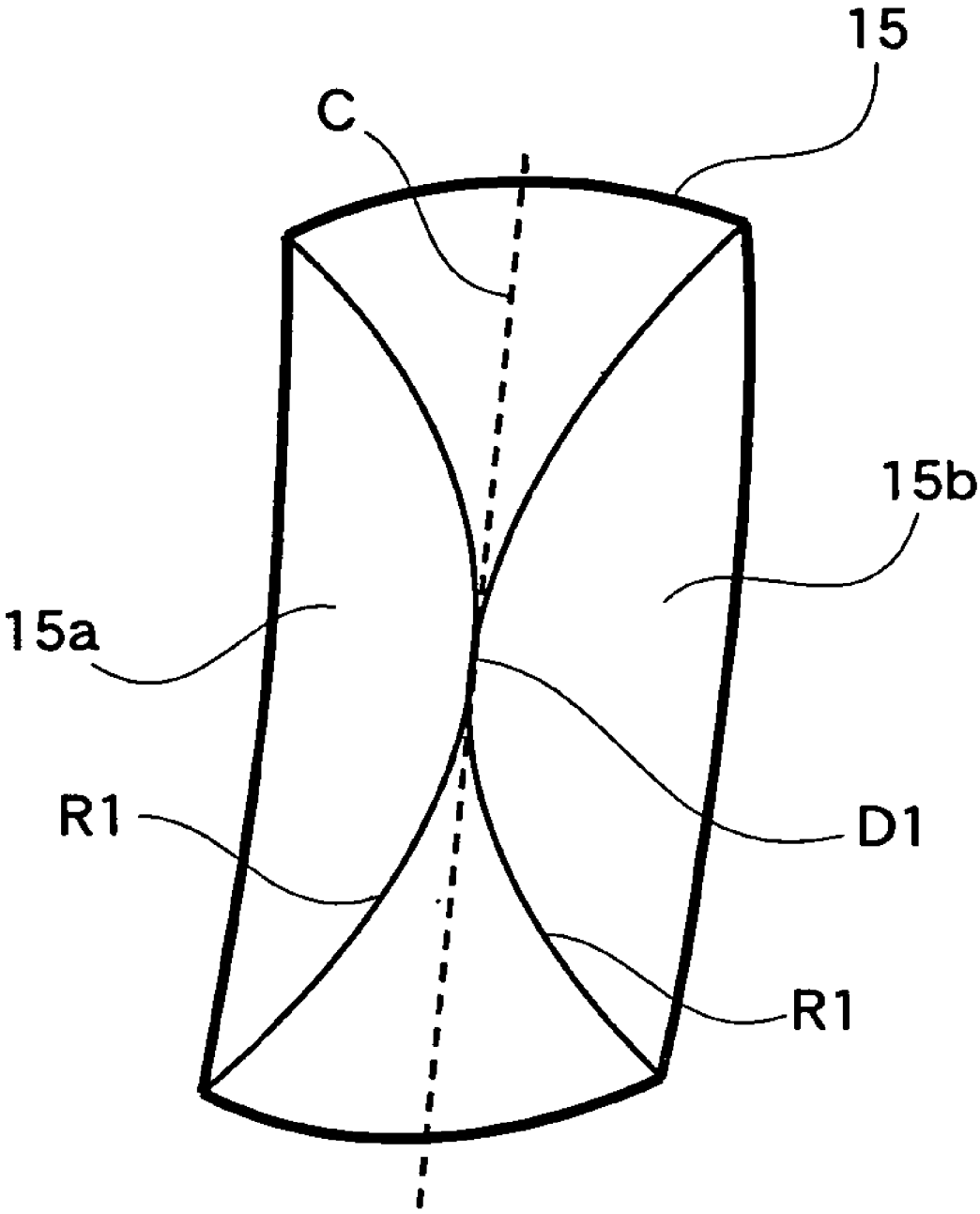
FIG. 8 is an enlarged view of the groove of the core shown in FIG. 4.

A total of twelve grooves 15 are thus formed on the surface of the core 11, one at each midpoint between two adjacent intersections P. As shown in FIG. 8, in each groove 15, the bottom ends of a pair of inner surfaces 15*a* and 15*b* symmetrically extending in the spherical surface direction join at the deepest point D1, and the boundaries R1 between the pair of inner surfaces 15*a*, 15*b* and inner surfaces adjacent to the inner surfaces 15*a*, 15*b* are formed into arcs. By forming each grooves 15 so as to have such a shape, even when the core 11 is formed using a mold that can be split in half, as described later, the draft of the groove will not be undercut. Therefore, it is possible to readily remove the core 11 from the mold, simplifying the molding step.

The depth D of the groove is substantially the same as the height of the band B in the radial direction. For the same reasons as described in the first embodiment, it is preferable that the depth D be 1.0 to 2.0 mm. In this case, to improve the ball resilience and the impact feel, as in the Examples described later, the width W of the band B shown in FIG. 5 is set preferably at 3.8 to 8.5 mm and more preferably 7.0 to 8.0 mm. Alternatively, it is also possible to define the band B not by the width W but by the vertical angle □ of the sector. In this case, it is preferable that the vertical angle □ be 90 to 150°. When the height of the band B, i.e., the depth D of the groove, is 1.0 to 2.0 mm, the length of the grooves 15 in the spherical surface direction is 12.4 to 17.3 mm. Note that because the diameter, material and hardness of the core 11 are the same as those in the first embodiment, a detailed explanation thereof is omitted here.

In the present embodiment, each grooves 15 is formed by excising the band B with the plane S passing the top portion B2 of the sector-shaped cross-sectional profile; however, the plane need not necessarily pass the top portion B2 as long as it is perpendicular to the normal line N of the core 11 that passes the midpoint M between two adjacent intersections P of the great circles C. In other words, as shown in FIG. 7(*b*), it is also possible to form each grooves 15 by excising the band B with a plane S1 that intersects the band B exterior to the top portion B2 of the sector-shaped cross-sectional profile in the radial direction of the core 11. In this case, as shown in FIG. 9, the shape of the resulted groove 15 is the same as that shown in FIG. 8 in that the boundaries R1 between the pair of inner surfaces 15*a*, 15*b* and the inner surfaces adjacent to the inner surfaces 15*a*, 15*b* are arc-shaped; however, it is different from that shown in FIG. 8 in that the pair of inner surfaces 15*a*, 15*b* symmetrically extending in the spherical surface direction are formed with a space between the innermost ends.

Figure 9:
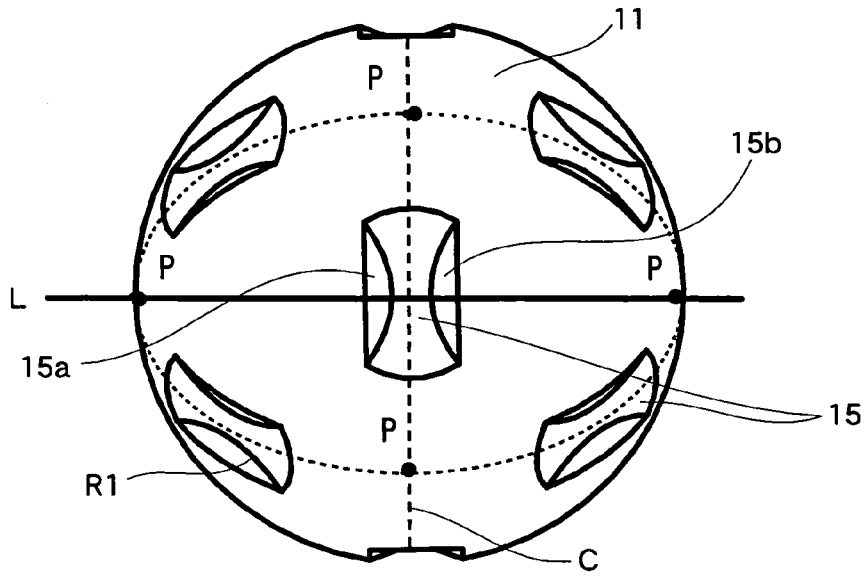
FIG. 9 shows (a) a front view and (b) a side view of a modified example of the core shown in FIG. 4.
Figure 9:
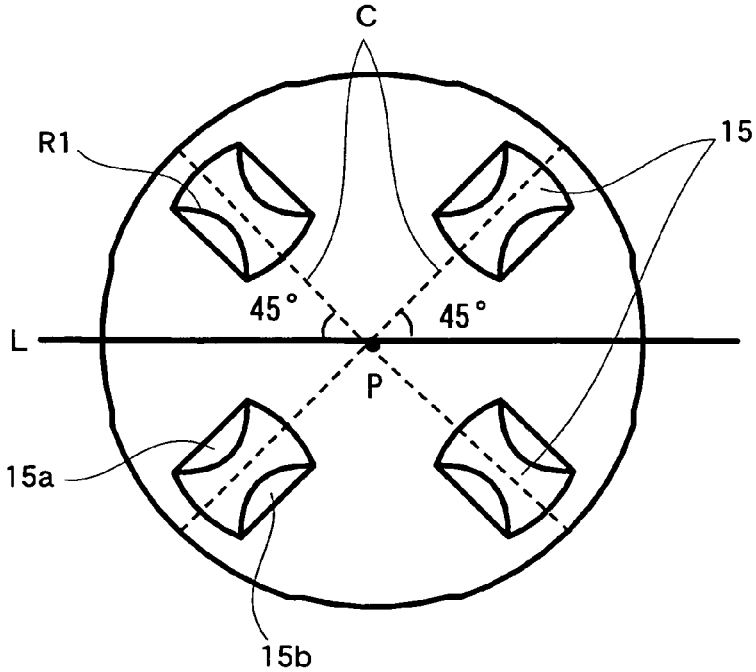

Even if the grooves 15 have the shape as shown in FIG. 9, they can be formed using a mold that can be split in half as in the case where the grooves 15 are formed as shown in FIG. 8, and therefore it is possible to obtain the core 11 by separating the mold at the parting line L shown in FIG. 9. The preferable depth, shape, etc., of the grooves 15 shown in FIG. 9 are the same as those of the grooves 15 shown in FIG. 8.

The cover 13 is formed so as to have the same thickness, material and hardness as that of the first embodiment, and twelve projections 19 engage in the grooves 15 are formed on the inner surface of the cover 13 as shown in FIG. 3.

A method for manufacturing the golf ball having such a structure is explained below. First, a core-mold (not shown) for producing the core 11 is prepared. This core-mold is so formed that its inner surface corresponds to the outer surface of the core 11. Therefore, twelve projections are provided to form twelve grooves 15 in the core 11. This mold comprises two portions, i.e., an upper part and a lower part, and can be split in half. Here, all that is necessary is the parting line between the upper part and the lower part of the mold is in a plane that intersects one of the three great circles C at a right angle and intersects the other two great circles C at 45°, for example, the line L as shown in FIG. 4(*a*) and FIG. 4(*b*).

Using such a core-mold, after placing a material for the core in the lower part of the mold, the upper part of the mold and the lower part of the mold are attached to each other, and the core is formed by compression molding. After pressing the mold at about 140 to 170° C. for 5 to 30 minutes, the upper part of the mold and the lower part of the mold are separated from each other and the molded core is removed. Because the projections of the mold are formed so as to have the shape as described above, it is readily possible to remove the core from the core-mold without being caught in. Subsequently, the removed core is placed in the cover-mold, and the cover is formed by injection molding or compression molding as in the first embodiment.

As described above, in the present embodiment, because the grooves 15 formed on the surface of the core 11 engage in the projections 19 of the cover 13, the cover 13 and the core 11 firmly contact each other as in the first embodiment, improving the ball resilience. Furthermore, because the grooves 15 are so formed that the core 11 can be formed using a mold that can be split into upper and lower parts, the productivity of the ball is improved, the time for producing the core 11 is reduced, and the cost of the mold is reduced. This makes it possible to mass-produce the cores 11 at low cost.

Note that the grooves 15 are not formed over the entire surface of the core 1 but, as in the first embodiment, are formed along the great circles C. Therefore, because the cover 3 and the core 1 are not so firmly attached to each other in the portions other than where the grooves 15 are formed, some extent of deformation is allowed when hit. As a result, soft impact feel is obtained.

The embodiments of the present invention are described above; however, the present invention is not limited to these embodiments and can be variously modified as long as it does not depart from the split of the present invention. For example, the grooves of the first embodiment have a V-shaped cross-sectional profile; however, it is also possible to form the grooves so as to have other shapes, such as an arc-shaped or a rectangular-shaped cross-sectional profile. Furthermore, to easily remove the core from the mold by using a mold that can be split in half, the shape of the grooves may be other than those of the second embodiment as long as the surface which constitutes the grooves is parallel to the direction in which the upper part of the mold and the lower part of the mold are separated from each other, or the grooves flare_outwards in the radial direction as it approaches to the parting line.

Examples and Comparative Examples of the second embodiment are described below. Here, golf balls of the second embodiment (Examples 1–15) and conventional golf balls without grooves (Comparative Example 1) are compared. Golf balls of Examples 1–15 and Comparative Example 1 are formed from the same components as shown in Table 1 and all of them have a diameter of 42.7 mm and a cover thickness of 1.7 mm.

TABLE 1

| Layer | Ingredients | Parts by weight |
|---|---|---|
| Core | BR-11 (JSR Corporation) | 100 |
| | Zinc oxide | 5 |
| | Barium sulfate | 17 |
| | Cross-linking initiator | 2 |
| | Zinc acrylate | 23 |
| | Antioxidant | 0.1 |
| Cover | Himilan 1557 (Mitsui-DuPont Poly chemicals Co., Ltd.) | 20 |
| | Himilan 1605 (Mitsui-DuPont Poly chemicals Co., Ltd.) | 20 |
| | Himilan 1855 (Mitsui-DuPont Poly chemicals Co., Ltd.) | 60 |

The dimensions of each ball are as shown in Table 2. Grooves are shaped so as to have the shapes shown in FIGS. 3 to 6. Each ball was press molded in such a manner as to have the components, proportions, and dimensions as described above.

TABLE 2

| | Grooves | Depth of the grooves (mm) | Width of the grooves (mm) | Length of the grooves (mm) | Angle □. (°) |
|---|---|---|---|---|---|
| Example 1 | Provided | 1.0 | 4.7 | 12.4 | 140 |
| Example 2 | Provided | 1.0 | 5.8 | 12.4 | 150 |
| Example 3 | Provided | 1.1 | 5.1 | 13.0 | 140 |
| Example 4 | Provided | 1.7 | 3.8 | 16.0 | 100 |
| Example 5 | Provided | 1.7 | 7.4 | 16.0 | 140 |
| Example 6 | Provided | 1.9 | 4.3 | 16.9 | 100 |
| Example 7 | Provided | 1.9 | 8.1 | 16.9 | 140 |
| Example 8 | Provided | 2.0 | 3.8 | 17.3 | 90 |

TABLE 2-continued

| | Grooves | Depth of the grooves (mm) | Width of the grooves (mm) | Length of the grooves (mm) | Angle □. (°) |
|---|---|---|---|---|---|
| Example 9 | Provided | 2.0 | 8.5 | 17.3 | 140 |
| Example 10 | Provided | 0.9 | 4.3 | 11.8 | 140 |
| Example 11 | Provided | 2.1 | 8.8 | 17.7 | 100 |
| Example 12 | Provided | 1.9 | 3.1 | 16.9 | 80 |
| Example 13 | Provided | 2.0 | 10.1 | 17.3 | 150 |
| Example 14 | Provided | 1.7 | 2.8 | 16.0 | 80 |
| Example 15 | Provided | 1.1 | 7.9 | 13.0 | 160 |
| Comparative Example 1 | Not provided | — | — | — | — |

The Shore D hardness of the core of each golf ball is 50 and that of each cover is 59.

Using the golf balls obtained in the Examples and Comparative Examples described above, hitting tests were conducted using a hitting robot (manufactured by Miyamae Co., Ltd.: product name "SHOT ROBO V") with a No. 1 Wood (1W: Mizuno Corporation; Mizuno 300S-II 380, loft angle: 9°, length: 44.75 inches (113.66 cm), shaft flex: S). The head speed of the 1W was set at 43 m/s. Tests of the feeling when hit were conducted by ten amateurs using a 1W. Feel when hit was evaluated at five grades (1: soft, 2: slightly soft, 3: neither soft nor hard, 4: slightly hard, 5: hard) by the ten amateur golfers and an average value was defined as the feeling value of each example. Table 3 shows the results.

TABLE 3

| | Carry distance (m) | Feeling value |
|---|---|---|
| Ex. 1 | 197.9 | 2.6 |
| Ex. 2 | 198.4 | 2.4 |
| Ex. 3 | 198.4 | 2.6 |
| Ex. 4 | 199.8 | 3.0 |
| Ex. 5 | 200.2 | 2.8 |
| Ex. 6 | 199.1 | 3.1 |
| Ex. 7 | 199.6 | 3.2 |
| Ex. 8 | 198.7 | 3.1 |
| Ex. 9 | 200.1 | 3.2 |
| Ex. 10 | 193.9 | 2.4 |
| Ex. 11 | 197.7 | 4.2 |
| Ex. 12 | 195.0 | 2.5 |
| Ex. 13 | 198.7 | 3.9 |
| Ex. 14 | 194.8 | 2.1 |
| Ex. 15 | 194.1 | 4.0 |
| Comp. Ex. 1 | 193.1 | 2.4 |

Golf balls of Examples 1 to 9 exhibit sufficient carry distance and excellent impact feel when hit. In contrast, Example 10 exhibits a reduced carry distance compared to Examples 1 to 9. This is presumably because the depth of the grooves is shallow and the cover tends to be displaced, and therefore the ball resilience is easily reduced. Compared to Examples 1 to 9, impact when hit of Example 11 feels hard, because the cover and the core are firmly contacted through the deep grooves.

Example 12 exhibits a carry distance less than those of Examples 1 to 9. It is assumed that this is because the cover tends to be displaced, as the contact area of the cover and the core is small since the width of the grooves is narrow. Compared to Examples 1 to 9, impact when hit of Example 13 feels hard. It is assumed that this is because the movable range of the cover tends to be limited since the grooves are wide.

Example 14 exhibits a carry distance less than those of Examples 1 to 9. It is assumed that the reason for this is the same as in Example 12, i.e., the width of the grooves is narrow since the vertical angle □of the sector is small. Compared to Examples 1 to 9, impact when hit a ball of Example 15 feels hard. It is presumed that the reason of this is the same as in Example 13, i.e., the width of the grooves is large since the vertical angle □ is large.

Compared to the above Examples, Comparative Example 1 exhibits a reduced carry distance. In particular, when Comparative Example 1 is compared to Examples 1 to 9, the difference in the carry distance is remarkable. No grooves are provided in a golf ball of Comparative Example 1, and therefore it can be deduced that the cover tends to be displaced and ball resilience is decreased.

As explained above, the Examples exhibit both a long carry distance and excellent impact feel. It is clear that they are superior to the Comparative Example.

(Third Embodiment)

Figure 10:
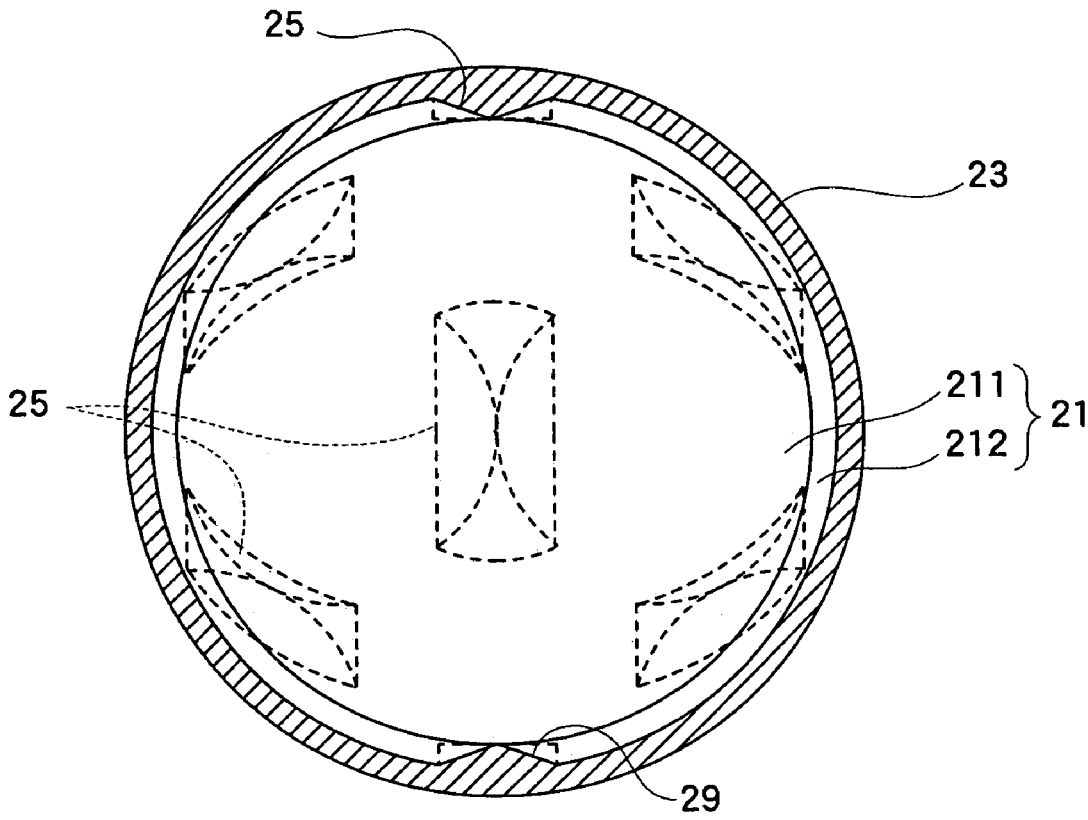
FIG. 10 is a cross-sectional view showing a golf ball according to a third embodiment of the present invention.

A third embodiment of the present invention is explained below. FIG. 10 is a cross-sectional view of a golf ball of the present embodiment. As with the golf balls of the above-explained embodiments, the golf ball of the present embodiment comprises a spherical core 21 having grooves 25 on its surface and a cover 23 that covers the core 21, wherein projections 29 engage in the grooves 25 are formed on the inner surface of the cover 23.

The golf ball of the present embodiment has a diameter and an outward form as the same as that of the second embodiment and is characterized in that the core 21 has a two-layered structure. In other words, the core 21 comprises a spherical main part 211 and an interlayer 212 that covers the surface of the main part 211, wherein the surface of the spherical interlayer 212 is provided with the grooves 25. Each groove 25 has the same shape as the grooves 15 of the second embodiment shown in FIG. 3 and a total of twelve grooves, the same as the number of grooves 15 of the second embodiment, are provided.

The materials and hardness thereof usable for the core 1 in the first embodiment are preferably used as the material for the main part 211. The materials and hardness thereof usable for the cover 1 in the first embodiment are preferably used as the material for the cover 23. The thickness of the cover 23 is the same as that of the cover 1 of the first embodiment.

The interlayer 212 is formed from a rubber composition or elastomer. When the interlayer 212 is formed from a rubber composition, it is possible to use the same materials for the core 21, and when the interlayer 212 is formed from an elastomer, it is possible to use the same materials for the cover 23. The thickness of the interlayer 212 is substantially the same as the depth of the grooves 25, and, as mentioned in the first embodiment, is preferably from 1.0 to 2.0 mm and more preferably from 1.5 to 1.8 mm.

The golf ball of the present embodiment strengthens the contact between the core 21 and the cover 23 through the engagement of the grooves 25 formed in the core 21 with the projections 29 formed on the inner surface of the cover 23 as in the previously described embodiments. This structure reduces energy losses when energy is transferred from the cover 23 to the core 21 when hit, improving the ball resilience.

Because the core 21 has a two-layered structure comprising a main part 211 and an interlayer 212, by suitably selecting the hardness of the main part 211 and the interlayer 212 that can cope with various conditions such as head speed, it is possible to readily obtain both a high ball resilience and soft feel. For example, when the hardness of the interlayer 212 is set higher than that of the main part 211 and the hardness of the cover 23 is set lower than that of the interlayer 212, it is possible to increase the carry distance by maintaining the excellent ball resilience due to the interlayer 212 and improve the impact feel due to the cover 23. In contrast, when the hardness of the interlayer 212 is set lower than that of the main part 211 and hardness of the cover 23 is set higher than that of the interlayer 212, it is possible to increase the carry distance by maintaining an excellent ball resilience due to the main part 211 and the cover 23 and improve the impact feel due to the interlayer 212. As described above, by forming the core 21 to have a two-layered structure, design flexibility can be increased, allowing the desired characteristics to be readily obtained.

The hardness of the main part 211, interlayer 212 and cover 23 can be set by suitably selecting the materials. For example, when the main part 211 or the interlayer 212 is formed from a rubber composition, it is possible to enhance the hardness by increasing the compound ratio of unsaturated carboxylic acid and organic peroxide.

A method for manufacturing a golf ball of the present embodiment is explained below. First, a rubber composition is pressed in a mold (not shown) at, for example, 130 to 160° C. for 5 to 25 minutes, obtaining a spherical main part 211. The main part 211 may be formed from an elastomer as described above. In this case, it is possible to form the main part 211 not only by press molding but also by injection molding.

Figure 11:
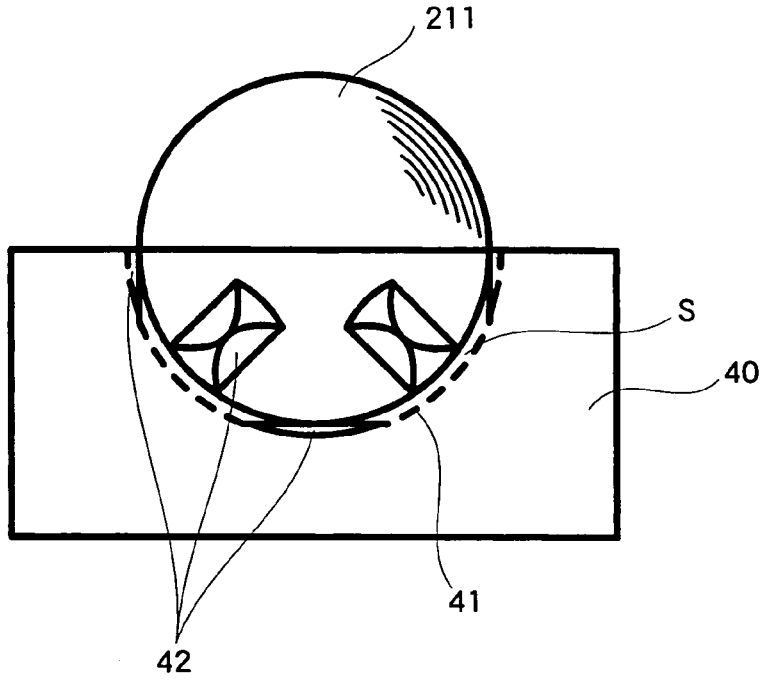
FIG. 11 shows (a) a side view and (b) a perspective view for explaining a method for forming the core of FIG. 10.
Figure 11:
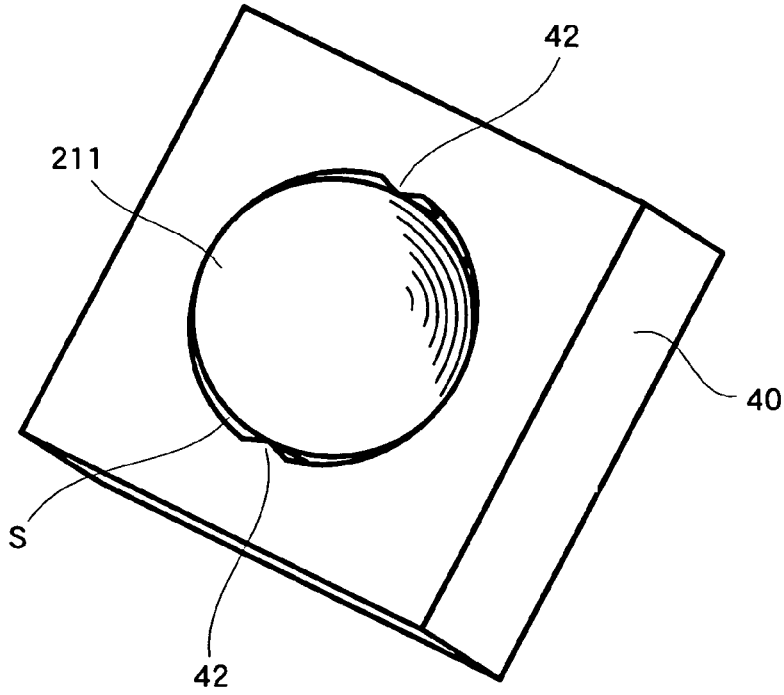

Second, the thus formed main part 211 is placed in a core-mold. The same mold used in the second embodiment can be used as the core-mold. FIG. 11 shows the main part 211 placed in the lower part of the mold 40 of the core-mold, wherein FIG. 11(*a*) is a side view and FIG. 11(*b*) is a perspective view.

As shown in FIG. 11, the lower part of the mold 40 comprises a hemispherical receiving portion 41, wherein a plurality of projections 42 are formed on the inner surface of the receiving portion 41 to form grooves 25 of the core 21. The upper part of the mold of the core-mold is not shown; however, it has the same structure as the lower part of the mold 40.

When the main part 211 is placed in the core-mold, the tips of the projections 42 hold the main part 211 by contacting the surface of the main part 211, and a space S is formed between the main part 211 and the inner surface of the receiving portion 41. Thereafter, by placing a material having a hardness different from that of the main part 211 in the space S, a core 21 comprising the main part 211 covered with an interlayer 212 is obtained. Grooves 25 are formed on the surface of the core 21 in positions corresponding to those of the projections 42. By forming the core 21 in such a manner, it is possible to reliably hold the main part 211 in the center of the receiving portion 41 with each projection 42 of the core-mold. This makes it possible to accurately align the center of the main part 211 with the center of the interlayer 212.

Subsequently, the core 21 is removed from the core-mold and placed in a cover-mold as in the first and second embodiments and then covered by a cover 23 by injection molding or compression molding. The grooves 25 formed in the core 21 thereby correspond to the projections 29 formed on the cover 23. The golf ball of the present embodiment is thus completed. In the method for producing the golf ball of the present embodiment, as in the second embodiment, because a mold that can be split in half is used as the core-mold, it is possible to improve productivity. It is also possible to easily produce the core 21 having a two-layered structure of different hardness, reliably prevent eccentricity of the core 21, and obtain an excellent yield.

Examples and Comparative Examples of the third embodiment are shown below. Here, golf balls of the third embodiment (Examples 16 and 17) are compared with conventional balls without grooves (Comparative Examples 2 and 3). Golf balls of Examples 16 and 17 and Comparative Examples 2 and 3 have the same structure except for the presence or absence of grooves, wherein the diameter of the main part is 39.3 mm, the thickness of the interlayer is 1.7 mm, and the thickness of the cover is 1.7 mm. Each groove of Example 16 and 17 has a depth of 1.7 mm, width of 3.8 mm, length of 16.0 mm, and a vertical angle □ (see FIG. 5) of 100°.

In the golf balls of Examples 16 and 17 and Comparative Examples 2 and 3, the hardness of the main part differs from that of the interlayer. In Example 16 and Comparative Example 2, the hardness of the interlayer is higher than that of the main part, and the hardness of the cover is lower than that of the interlayer. In contrast, in Example 17 and Comparative Example 3, the hardness of the interlayer is lower than that of the main part and the hardness of the cover is higher than that of the interlayer. The materials of the core, interlayer and cover of Examples and Comparative Examples and their hardnesses are shown in Table 4.

TABLE 4

| | Main Body | Interlayer | Cover |
|---|---|---|---|
| Example 16<br>Comp. Ex. 2 | BR48 | S61 | S59 |
| Example 17<br>Comp. Ex. 3 | BR52 | BR46 | S63 |

In Table 4, "BR" stands for butadiene rubber, "S" stands for ionomer resin ("Surlyn" manufactured by Du Pont-Mitsui Polychemicals Co., Ltd.). The number following "BR" or "S" stands for the hardness (Shore D hardness). The compounding ratio of each material in parts by weight is shown in Tables 5 and 6.

TABLE 5

| | BR52 | BR48 | BR46 |
|---|---|---|---|
| BR | 100 | 100 | 100 |
| Zinc oxide | 5 | 5 | 5 |
| Barium sulfate | 17 | 18 | 19 |
| Cross-linking initiator | 2 | 2 | 2 |
| Zinc acrylate | 24 | 20 | 18 |
| Antioxidant | 0.1 | 0.1 | 0.1 |

TABLE 6

| | S59 | S61 | S63 |
|---|---|---|---|
| Himilan 1557 | 20 | — | — |
| Himilan 1605 | 20 | — | 50 |
| Himilan 1855 | 60 | — | 19 |
| Himilan 1601 | — | 50 | 2 |
| Himilan 1706 | — | 50 | 18 |

*Himilan is a trademark registered by Du Pont-Mitsui Polychemicals Co., Ltd.

Impact test for measuring the carry distances and feeling values were conducted under the same conditions as in the Examples of the second embodiment. Table 7 shows the results.

TABLE 7

| | Carry distance (m) | Feeling value |
|---|---|---|
| Example 16 | 198.4 | 2.4 |
| Example 17 | 201.4 | 2.8 |
| Comparative Example2 | 198.3 | 4.2 |
| Comparative Example3 | 196.4 | 2.6 |

As is clear from Table 7, in the cases wherein the hardness of the interlayer was greater than that of the main part (Example 16 and Comparative Example 2), there is no significant difference in the carry distance, but feeling value is greatly improved in Example 16. In the cases wherein the hardness of the interlayer is lower than that of the main part (Example 17 and Comparative Example 3), there is no significant difference in feeling values, but the carry distance of Example 17 is greatly improved. Therefore, in both the cases where the hardness of the interlayer is greater or lower than that of the main part, better results with respect to high ball resilience and soft feel are obtained by employing the structure of the present invention.

The invention claim is:

1. A golf ball comprising:

a spherical core; and a cover covering the spherical core, wherein the core is provided with grooves solely along three great circles drawn around the core so as to intersect each other at right angles and provide eight regions on the surface of the core surrounded by the great circles, and the inner surface of the cover is provided with projections engaging in the grooves, wherein the grooves are provided in a plurality of locations over only a portion of the great circles so as to be substantially point symmetrical around the center of the core.

2. A golf ball according to claim 1, wherein the core comprises a spherical main part and an interlayer covering the surface of the main part, the grooves are formed on the surface of the interlayer, and the hardness of the main part differs from that of the interlayer.

3. A golf ball according to claim 2, wherein the hardness of the interlayer is greater than that of the main part, and the hardness of the cover is less than that of the interlayer.

4. A golf ball according to claim 2, wherein the hardness of the interlayer is less than that of the main part, and the hardness of the cover is greater than that of the interlayer.

5. A golf ball according to claim 1, wherein the depth of each groove as measured from the surface of the core is 1.0 to 2.0 mm.

6. A golf ball according to claim 1, wherein the grooves are formed by excising a portion of bands that extend along each of the three great circles that are hypothetically drawn on the surface of the core so as to intersect each other, and that have a sector shape in cross section with the arc section of the sector corresponding to the core surface, the excision being made along a plane that is perpendicular to a line normal to the core that passes through the midpoint between the intersections of the three great circles.

7. A golf ball according to claim 6, wherein the plane excising the band passes the top portion of the sector-shaped cross-sectional profile of the band.

8. A golf ball according to claim 6, wherein the plane excising the band passes exterior to the top portion of the sector-shaped cross-sectional profile of the band in the radial direction.

9. A method for manufacturing the golf ball of claim 6 comprising:

a first step of preparing a core-mold provided with projections corresponding to the grooves on the inner surface thereof, the core-mold being able to be split in half by a parting line on a plane that intersects one of the three great circles at a right angle and the two other great circles at 45°, a second step of producing a core by placing a material for the core in the core-mold and conducting compression molding, and a third step of providing a cover around the surface of the core produced in the second step.

10. A method for manufacturing a golf ball according to claim 9, wherein the second step comprises a step of placing a spherical main part in the core-mold, and then placing a material having a hardness different from that of the main part in a space between the main part and the core-mold.

11. A golf ball comprising:

a spherical core; and a cover covering the spherical core, wherein the core is provided with grooves along three great circles drawn around the core so as to intersect each other at right angles, and the inner surface of the cover is provided with projections engaging in the grooves;

wherein the grooves are formed by excising a portion of bands that extend along each of three great circles that are hypothetically drawn on the surface of the core so as to intersect each other, and that have a sector shape in cross section with the arc section of the sector corresponding to the core surface, the excision being made along a plane that is perpendicular to a line normal to the core that passes through the midpoint between the intersections of the three great circles; and wherein the depth of each groove as measured from the surface of the core is 1.0 to 2.0 mm, and the width of each groove is 3.8 to 8.5 mm.

12. A golf ball comprising:

a spherical core; and a cover covering the spherical core, wherein the core is provided with grooves along three great circles drawn around the core so as to intersect each other at right angles, and the inner surface of the cover is provided with projections engaging in the grooves;

wherein the grooves are formed by excising a portion of bands that extend along each of three great circles that are hypothetically drawn on the surface of the core so as to intersect each other, and that have a sector shape in cross section with the arc section of the sector corresponding to the core surface, the excision being made along a plane that is perpendicular to a line normal to the core that passes through the midpoint between the intersections of the three great circles; and wherein the depth of each groove as measured from the surface of the core is 1.0 to 2.0 mm, and the vertical angle of the sector is 90 to 150°.

* * * * *